United States Patent [19]

Brett et al.

[11] 3,986,703

[45] Oct. 19, 1976

[54] MOVEMENT OF SCENERY IN THEATERS AND STUDIOS

[75] Inventors: Richard G. Brett, Croydon; Eric M. Langham, Norwich; Ian R. Young, Sunbury-on-Thames, all of England

[73] Assignee: Evershed Power-Optics Limited, London, England

[22] Filed: Aug. 8, 1975

[21] Appl. No.: 603,175

Related U.S. Application Data

[63] Continuation-in-part of Ser. No. 372,030, June 21, 1973, abandoned.

[52] U.S. Cl. ..... 254/173 R; 254/141; 254/187 G

[51] Int. Cl.[2] ..... B66D 1/48

[58] Field of Search ..... 254/141, 173 R, 184, 254/186 R, 187 G, 183; 187/29 C, 29 D, 29 W, 29 R; 214/16.1 C, 16.1 B; 60/706, 713, 328

[56] References Cited

UNITED STATES PATENTS 3,189,195 6/1965 Fox, Jr. et al. ..... 254/173 R 3,596,070 7/1971 McCool ..... 254/173 R 3,780,990 12/1973 Edlund et al. ..... 254/173 R

*Primary Examiner*—Frank E. Werner

*Assistant Examiner*—Kenneth Noland

*Attorney, Agent, or Firm*—Kemon, Palmer & Estabrook

[57] ABSTRACT

When a load is to be moved between preselected points along a path such that its weight aids movement in one direction and opposes it in the other (for example when scenery supported from a hoist is to be moved between "deads" in a theater or studio), the supported load is initially weighed and a signal representing its weight is stored. This signal is extracted from store when movement between positions is required and is applied to the hoist driving system to provide a torque balancing the load weight before a brake on the hoist driving system is removed. Thereafter the load is moved to the new position, the brake is reapplied and the stored weight signal is removed from the driving system.

4 Claims, 1 Drawing Figure

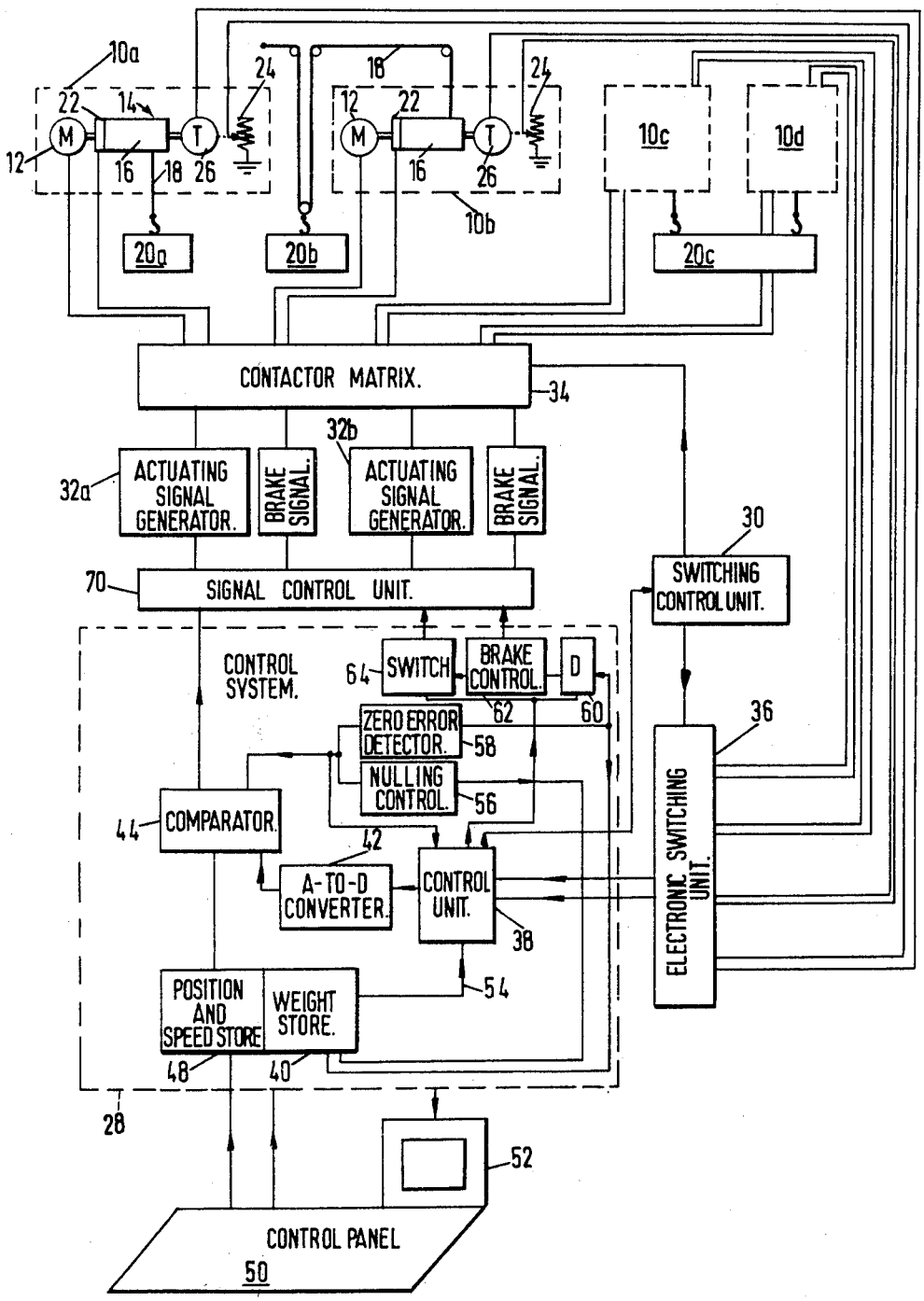
10a
22
14
12
M
T
16
18
26
24
18
12
22
M
T
16
26
24
10b
10c
10d
20a
20b
20c
CONTACTOR MATRIX.
34
32b
32a
ACTUATING SIGNAL GENERATOR.
BRAKE SIGNAL.
ACTUATING SIGNAL GENERATOR.
BRAKE SIGNAL.
30
SWITCHING CONTROL UNIT.
70
SIGNAL CONTROL UNIT.
CONTROL SYSTEM.
64
SWITCH
BRAKE CONTROL.
D
62
60
ZERO ERROR DETECTOR.
58
NULLING CONTROL.
56
36
44
COMPARATOR.
42
A-TO-D CONVERTER.
CONTROL UNIT.
38
ELECTRONIC SWITCHING UNIT.
POSITION AND SPEED STORE
WEIGHT STORE.
54
48
40
28
52
CONTROL PANEL
50

MOVEMENT OF SCENERY IN THEATERS AND STUDIOS

The present application is a continuation-in-part of our application Ser. No. 372,030 of June 21, 1973, now abandoned.

This invention is concerned with the hoisting of scenery in theatres and studios.

This is traditionally accomplished manually, for example by suspending a canvas screen from a bar and passing hoisting ropes, connected at points spaced along the bar, over pulleys to a counterweight, a further rope passing over a pulley is positioned for manual actuation when it is required to hoist or lower the scenery, the effective load being only the out-of-balance weight between the scenery and the counterweight.

A motor-driven arrangement for moving theatre and studio scenery has been used where the noise level of the driving units is not very important. However, for theatres or studios which require a very low level of noise, it has been considered undesirable to use motor-driven hoists.

We have devised a motor-driven load-positioning method and apparatus with a low noise level and which is capable of automatically controlling the position of large number of pieces of scenery. Apparatus embodying the present invention comprises an actuator including a motor, a brake for arresting the operation of the actuator, a hoist directly driven by the AC motor and having a drum rotatable to move a piece of scenery between preselected points along a path such that the weight of the scenery aids movement in one direction of the path and opposes it in the other direction, and a position-sensing means for continuously generating a position-representing signal; an actuating signal generator generates a signal to drive the actuator. The apparatus further comprises data storage means including first long-term storage means for storing data representing positions from which and to which the scenery is to be moved and second long-term storage means for storing weight data representing the power required to be provided by the actuating signal generator, in the absence of the brake, to maintain the scenery in a preselected position against the pull of gravity. A control means includes a brake control means and a comparator for controlling an actuating signal generator, the comparator being responsive to position-representing signals from the position signal store and to signals from the actuator position-signal generator and forming, with the actuator and actuating signal generator, a closed-loop positioning servo system whereby the hoist drum may be driven in rotation to move the scenery attached to the hoist from a first position to a second position along the said path; when a piece of scenery is to be moved the control means first extracts the weight-representing data from the second-storage means and extracts from the said first storage means data representing the position from which the scenery is to be moved, and applies signals corresponding to the said weight and position data to the closed-loop positioning servo system; thereafter it actuates its brake-control means to remove the brake, applies to the closed-loop positioning servo system a signal corresponding to the stored data representing the required position, actuates the brake control means to cause it to re-apply the brake when the required position has been reached and then removes from the closed-loop positioning servo system the said weight-representing and position-representing signals.

Generally it is advantageous to provide a number of actuating signal generators which is less than the number of actuators, with a selecting means for coupling a selected actuating signal generator to a selected actuator in response to signals from a control unit.

By storing the value of power required to maintain the position of the load and applying the corresponding power to the motor prior to removal of the brake, we can dispense with the use of a self-sustaining or high-ratio gear box (for example a gear box with a ratio of greater than 10:1), and thereby greatly reduce the noise level of the driving system. We can use an AC motor preferably running at a low speed, by which we mean a speed of less than 900 r.p.m. and preferably less than 500 r.p.m.

The use of AC motors is highly advantageous in view of their ability to operate satisfactorily in this application at low speeds of rotation and thus to drive the hoist directly, by which we mean without the interposition of a gear box.

It has previously been proposed, in U.S. Pat. No. 3,614,996 to construct an elevator control system including means for detecting, at the commencement of an elevator car movement, the unbalanced torque to permit a smooth start to the movement. However, this specification was not concerned with a closed-loop positioning control system or with a motor directly driving a winding drum, nor did it provide a number of actuating signal generators, for deriving movement-control signals for the hoists, less than the number of motor-driven hoists.

In the above discussion, we have used the term "hoist" in connection with the movement of scenery. The invention is also applicable to the control of "wagons", that is to say trolleys moving across the stage, when the weight of the wagon assists movement in one direction and opposes it in the other direction, as on a sloped stage. In this specification the term "hoist" is to be understood as including such wagons.

The actuating signal generators may advantageously be AC multi-phase electronic drives, such as a solid-state cycloconvertors using thyristors, although for very low power systems it is possible to use transistor units (for example, mark-space ratio transistor units) to provide the driving currents. What is preferred is a multi-phase variable frequency source, which should also provide a variable amplitude signal in order to maintain the operation of the motor within its thermal dissipation ratings.

A further very desirable feature in theatre scenery-shifting arrangements is that different motors can be made to operate synchronously. For example, point hoists at different positions above the stage may be required to pull up different pieces of scenery at the same time and at the same rate. The use of a tight closed-loop servo system with the AC motors and electronic drives of the present invention permits this synchronous operation or electrical linking of point hoists.

The preferred servo loop is a semi-analogue semi-digital system and both the analogue portion and the digital portion have their own checking arrangements.

Included in the control system are stores which store information such as the positional end points or "deads" for a given movement of a given piece of scenery; they may also store, for example, calibration curves for resetters or data for compensating for an eccentric driving drum.

The use of motors to drive hoists does not mean that counterweights cannot be used. It is possible to use a power-assisted counterweighted hoist, a small motor replacing the operator on the subsidiary rope. In general, however, the out-of-balance weight will be increased in a power-assisted system.

In order that the invention may be better understood, one example of scenery-hoisting apparatus embodying the invention will now be described with reference to the accompanying drawing, which is a block diagram showing the essential components of a scenery-hoisting control system embodying the invention.

In FIG. 1, there are shown four actuators 10*a*, 10*b*, 10*c* and 10*d*, each including an AC motor 12 driving a hoist 14. The hoist 14 has a drum 16 rotatable to wind up or unwind a hoist wire 18 to move pieces of scenery 20*a*, 20*b* and 20*c*, the piece of scenery 20*c* being carried jointly by the two hoists of actuators 10*c* and 10*d*. Each actuator includes a brake 22 for arresting the rotation of the drum and further includes a position signal generator 24 and a tacho generator 26. To energise an actuator, a control unit 28 acts through a switching control unit 30 to select a control path for actuation and feedback signals (via switching units 34 and 36). An actuating signal generator 32*a* or 32*b* is caused by the signal control unit 70 (itself commanded by control unit 28) to generate an appropriate signal for the actuator. The actuating signal generators 32*a* and 32*b* may be cycloconvertors and the selected generator supplies power through the contactor matrix 34 to the required actuator 10. The number of actuating signal generators is less than the number of actuators. As an example, in a typical installation there may be 170 actuators and 35 actuating signal generators.

The motors 12 may be squirrel cage motors driven at a frequency of 0 to 15 Hz, phased to give control of the direction of rotation of the motor. It will be seen that the arrangement differs from previous proposals for motor-driven scenery hoists in that there is no gearbox between the motor and the drum. The omission of the gearbox is made possible by storing within the controlled system 28 data representing the power required to be applied to the motor to maintain the hoist position when the brake is removed, as will be explained.

Signals from the position signal generators 24 and the tacho generators 26 are applied through the electronic switching unit 36 to the control system 28 to complete a closed-loop positioning servo system. In a system employing closed-loop positioning, without a weight-compensating signal, in order that the motor should produce enough torque to hold the load stationary there would necessarily be an error signal, because this error signal is required to unbalance the actuating signal generator and thereby provide energisation for the motor. This error signal would be the difference between the demand and reset signals with the scenery at rest and the brakes released. Consequently, in any scenery positioning operation there would be an error in the scenery position, the magnitude of the error depending on the weight of the scenery. There would also be a "shock" movement of the scenery upon release of the brakes.

In FIG. 1, the signals from the position signal generator 24 and the tacho generator 26 are applied through the switching unit 36 to a control unit 38 which also receives a weight signal from a long-term store 40, this being the signal representing the torque required to balance the load at standstill. The output signals from the unit 38 are converted into digital form in an analogue-to-digital converter 42 of the pulse-width type and these signals are applied to a comparator 44 which also requires from a long-term store 48 signals representing the required load position and the required speed of its movement to this position. The comparator 44 determines the position error and the required rate of movement to correct this error and applies a signal through the signal control unit 70 to the selected actuating signal generator 32*a* or 32*b*. The actuating signal generator includes a voltage controlled oscillator so that the motor receives a driving signal of a frequency which varies to control the speed of the motor and also receives a voltage which varies to provide a constant flux in the motor.

The timing of operations carried out by the control system 28 is under the control of an operator seated before a panel 50 provided with a visual display unit 52, the display unit 52 receiving information from the control system 28.

Initially, when there is applied to the hoist a new piece of scenery for which there is no weight record, a weight signal must be derived and stored. The method of deriving this signal will now be described. A signal representing a required position for the scenery is inserted into the store 48, under the control of the panel 50. The motor is then energised to drive the scenery to this required position, i.e., to drive the hoist until the signal derived from the potentiometer constituting the position signal generator 24 is equal and opposite to the required-position signal serived from the store 48. When the hoist reaches the new position there will be a difference between the signal from store 38 and signal from the potentiometer in the actuator. This difference represents the torque required to hold the load and appears as an error of position, as explained above. An additional torque signal is therefore applied to the control unit 38 over line 54 to counter the effect of the weight. The value of this signal is controlled by a further error-nulling loop including a nulling-control circuit 56 which alters the value of the additional signal until the load is static with the error reduced to zero. A zero error detector circuit 58 then comes into operation and causes the prevailing value of the weight signal to be entered into the weight store 40, where it is correlated with data representing the hoist in question. The ouput signal from the zero error detector 58 also acts, through the control unit 38 via a delay circuit 60, to actuate a brake-applying unit 62 which in turn operates a switch 64 to switch off the power to the motor once the brake has been applied.

The system is now ready to control the movement of the scenery from an existing preselected first position to the said second position. Initially, a signal representing the first position is again applied from store 48 to comparator 44 and the weight signal for the hoist in question is selected from the store 40 and is applied to the control unit 38. After a short delay to allow the system to stabilise, the brake control unit 62 is conditioned to remove the brakes. The new position value, which has been applied to the store 48 from the control panel, is extracted from the store and is applied to comparator 44 in place of the existing position signal. In fact, the store 48 additionally provides a signal representing the desired speed profile of the movement and consequently the command signal applied to the comparator 44 calls for a progressive movement of the scenery to the new position at the desired speed. The weight signal on line 54 is of course maintained constant. When the scenery reaches the new position under the control of the position-error nulling loop, the zero error is detected, the brakes are applied and the system is switched off.

The system described is extremely flexible. For example, the position store frequently stores a number of positions for a single hoist, since in many cases a piece of scenery is required to take up several positions in the course of a performance. Additionally, where the number of hoists is inadequate for the number of pieces of scenery, a piece of scenery used at one stage of a performance may be replaced by another for a later stage and this will require a change in the stored weight signal as well as, in all probability, a change in the required position signals.

Furthermore, a single piece of scenery may require the storing of different weight signals for use at different times in a single performance. For example, a piece of scenery may be "flown" on to the stage with a group of actors, or even a group of objects, supported upon it. When this piece of scenery is removed, the actors may have stopped off or the objects may have been removed, so that a different weight signal will then be required before the brake is removed from the hoist. In another example, a piece of scenery which is suspended above the stage at one part of the performance may be partially supported at another part of the performance. In one extreme example, in a shipwreck scene a mast supported on the floor was required to swing about to give the impression of the shipwredk, its upper end being suspended from a hook. To swing the mast, different position signals were required to be applied in succession to the control system and, because each position of the top of the mast represented a different angle of tilt, different load signals were required for each position to prevent a sudden drop in the position of the upper end of the mast on release of the brakes prior to each new change of position.

The feature represented by the piece of scenery 20*c*, suspended from two actuators, illustrates another advantage of the present invention. Theatrical scenery is not of itself a rigid structure and as a result conventional load sharing as between one servo unit and another is not possible. It is therefore of critical importance that each element should be capable of maintaining a known and recorded share of the load, as otherwise the load will distort and in the extreme will disintegrate. The system described above provides this predetermined and controlled load sharing and is therefore extremely advantageous for the operation of grouped actuators. The operator indicates by means of a button on the control panel that he wishes to form a group of actuators and then keys in the hoist numbers to be included in the group. The use of AC motors has a further advantage, in addition to the advantage of slow speed operation permitting driving the drums without gearboxes. This second advantage over DC motors is that they are less expensive and this is important in an application where the total number of motors in the system is large compared with the number in use at any instant.

If desired, the hoist may include a counterweight and may have alternative ropes, one of which passes round a motor-driven pulley and the other of which can be pulled by hand with the motor disengaged. The invention can be applied to both point hoists (i.e., hoists working a single-purchase or double-purchase hook) and bar hoists, in which a bar from which the scenery is suspended is lifted by ropes spaced along the bar.

It will be appreciated that the use of the invention leads to smoothly controlled movement of scenery without excessive noise. The desirability of storing the required torque value and applying it to the motor before the brake is released can be seen from a consideration of the effect of releasing the brake accidentally. The re-application of the accidentally released brake requires several hundred milliseconds and this may correspond to 2 feet of movement of the suspended scenery. Although the positioning servo starts to generate torque in reponse to the error signal in such a case, it cannot react quickly enough to prevent a fall of several inches in the position of the scenery. In the absence of a stored weight signal a "shock" fall of this kind would precede each new positioning movement.

In the above description only a single hoist has been considered. Typically, for any particular stage production there is a large number of hoists which are organised into groups and any group can be selected for actuation at any time. For each group, the control unit is set up with selected values for the required positions of the scenery. Checking systems are provided for detecting high and low position of the scenery, slack in the wire, overload and failure of a drive unit.

The position control system may include both coarse and fine potentiometers in place of the single position-sensing potentiometer 24. The long-term stores 40 and 48 are, in practice, parts of a single data storage means.

We claim:

1. Apparatus for controlling the movement of scenery in a theatre or studio, comprising:

an actuator including an AC motor, a brake for arresting the operation of the actuator, a hoist directly driven by the AC motor and having a drum rotatable to move a piece of scenery between preselected points along a path such that the weight of the scenery aids movement in one direction of the path and opposes it in the other direction, and a position-sensing means for continuously generating a position-representing signal;

an actuating signal generator for generating a signal to drive the actuator;

data storage means including first long-term storage means for storing data representing positions from which and to which the scenery is to be moved and second long-term storage means for storing weight data representing the power required to be provided by the actuating signal generator, in the absence of the brake, to maintain the scenery in a preselected position against the pull of gravity;

and control means, including a brake control means and a comparator for controlling an actuating signal generator, the comparator being responsive to position-representing signals from the position signal store and to signals from the actuator position-signal generator and forming, with the actuator and actuating signal generator, a closed-loop positioning servo system whereby the hoist drum may be driven in rotation to move the scenery attached to the hoist from a first position to a second position along the said path;

the control means first extracting the weight-representing data from the second-storage means and extracting from the said first storage means data representing the position from which the scenery is to be moved, and applying signals corresponding to the said weight and position data to the closed-loop positioning servo system, thereafter actuating its brake-control means to remove the brake, applying to the closed-loop positioning servo system a signal corresponding to the stored data representing the required position, actuating the brake control means to cause it to re-apply the brake when the required position has been reached and then removing from the closed-loop positioning servo system the said weight-representing and position-representing signals.

2. Apparatus as defined in claim 1, in which each actuator further includes a speed-sensing means for continuously generating a speed-representing signal during operation of the actuator, and in which the control means includes means comparing the said speed-representing signal from a selected actuator with a stored signal representing the required speed of movement of a piece of scenery, attached to the hoist, from a first position to a second position and controlling the signal applied to the closed loop-positiong servo system.

3. Apparatus for controlling the movement of scenery in a theatre or studio, comprising:

a plurality of actuators, each including a motor, a brake for arresting the operation of the actuator, a hoist driven by the motor and having a drum rotatable to move a piece of scenery between preselected points along a path such that the weight of the scenery aids movement in one direction of the path and opposes it in the other direction, and a position sensing means for continuously generating a position-representing signal;

a plurality of actuating signal generators, each adapted to generate a signal to drive an actuator, the number of actuating signal generators being less than the number of actuators;

selector means for coupling any selected one of the plurality of actuating signal generators to any selected one of the plurality of actuators;

data storage means including first long-term storage means for storing data representing a position to which the scenery is to be moved and second long-term storage means for storing data representing the power required to be provided by a selected actuating signal generator, in the absence of the brake, to maintain scenery attached to a selected actuator, coupled to the selected actuating signal generator, in a preselected position against the pull of gravity;

and a control system including brake control means, a comparator for controlling an actuating signal generator, the comparator being responsive to position-representing signals from the position signal store and to signals from the position sensing means of the selected actuator and forming, with the selected actuator and actuating signal generator, a closed-loop positioning servo system whereby the hoist drum may be driven in rotation to move the scenery attached to the hoist from a first position to a second position along the said path;

the control means first extracting the weight-representing signal from the store and applying a corresponding signal to the closed-loop positioning servo system, thereafter actuating the brake-control means to remove the brake, thereafter extracting from the position-signal store a signal corresponding to the required position and applying it to the closed-loop positioning servo system, thereafter actuating the brake control means to cause it to re-apply the brake, and then removing from the closed-loop positioning servo system the said weight-representing and position-representing signals.

4. Apparatus as defined in clain 3, in which the motor is an AC motor directly coupled to the hoist drum.

* * * * *